US005970964A

United States Patent [19]

Furuhata et al.

[11] Patent Number: 5,970,964

[45] Date of Patent: Oct. 26, 1999

[54] CIRCUIT DEVICE FOR IGNITING INTERNAL COMBUSTION ENGINE AND SEMICONDUCTOR DEVICE FOR IGNITING INTERNAL COMBUSTION ENGINE

[75] Inventors: Shoichi Furuhata; Shigeyuki Takeuchi; Tatsuhiko Fujihira, all of Kanagawa, Japan

[73] Assignee: Fuji Electric Co., Ltd., Kawasaki, Japan

[21] Appl. No.: 08/768,360

[22] Filed: Dec. 17, 1996

[30] Foreign Application Priority Data

Dec. 18, 1995 [JP] Japan ..... 7-328688
Feb. 13, 1996 [JP] Japan ..... 8-024972

[51] Int. Cl.[6] ..... F02P 3/05

[52] U.S. Cl. ..... 123/644; 315/209 T

[58] Field of Search ..... 123/644; 315/224, 315/209 T

[56] References Cited

U.S. PATENT DOCUMENTS

| | | | |
|---|---|---|---|
| 3,587,551 | 6/1971 | Harrow | 123/651 |
| 4,030,469 | 6/1977 | Chateau | 123/617 |
| 5,045,964 | 9/1991 | Bennett et al. | 123/644 |
| 5,115,369 | 5/1992 | Robb et al. | 361/93 |
| 5,446,385 | 8/1995 | Kugler et al. | 123/644 |
| 5,603,308 | 2/1997 | Ooyabu et al. | 123/644 |

FOREIGN PATENT DOCUMENTS

| | | |
|---|---|---|
| 55-3538 | 1/1980 | Japan . |
| 55-48132 | 11/1980 | Japan . |
| 2-185069 | 7/1990 | Japan . |
| 7-243369 | 9/1995 | Japan . |

*Primary Examiner*—Andrew M. Dollnar
*Attorney, Agent, or Firm*—Finnegan, Henderson, Farabow, Garrett & Dunner, L.L.P.

[57] ABSTRACT

A circuit is provided in which a voltage due to a minute current is applied to a gate terminal from a collector terminal when a collector voltage is higher than a gate voltage in an operation of current limitation. Thus, an increase in the collector voltage immediately after the operation of current limitation starts serves to boost the gate voltage. The boosted voltage suppress an abrupt increase in the collector voltage. When the collector voltage is reduced by oscillation, the action of boosting the gate voltage is lowered to suppress the reduction of the collector voltage.

9 Claims, 7 Drawing Sheets

DRAIN CURRENT : 2A/div
DRAIN VOLTAGE : 10V/div
TIME : 500 μs/div

MOSFET : WITHSTAND VOLTAGE ≧ 250V
ON-RESISTANCE ≦ 0.16 Ω

ORDINATE : COLLECTOR CURRENT 1A/div
ABSCISSA : COLLECTOR VOLTAGE 2A/div
BASE CURRENT : 1mA STEP (max. 6mA)

ORDINATE : DRAIN CURRENT 1A/div
ABSCISSA : DRAIN VOLTAGE 2A/div
GATE VOLTAGE : THREE POINTS OF 0.2V, 1V AND 2V FROM BOTTOM ORDINATE: DRAIN CURRENT : 2A/div
DRAIN VOLTAGE : 10V/div
ABSCISSA: TIME : 500 μs/div

CIRCUIT DEVICE FOR IGNITING INTERNAL COMBUSTION ENGINE AND SEMICONDUCTOR DEVICE FOR IGNITING INTERNAL COMBUSTION ENGINE

BACKGROUND OF THE INVENTION

1. Field of the Invention

The present invention relates to an ignition circuit for igniting a vehicle engine, and more particularly to a power transistor used in the circuit.

2. Description of the Related Art

FIG. 6 shows a conventional circuit. As an element for controlling a current flowing an ignition coil, a bipolar Darlington transistor 103 is used. As disclosed in Japanese Patent Examined Publication No. Sho 55-3538 and in U.S. Pat. No. 358,755, a current in a main circuit for current limitation is detected by connecting a resistor 106 to an emitter terminal of a bipolar Darlington transistor. As shown in FIG. 3 of U.S. Pat. No. 3,587,551, a transistor 104 for shunting a base current of the bipolar Darlington transistor 103 between the base of the Darlington transistor 103 and the ground of the resistor 106. The base terminal of the transistor 104 is connected to a point to which the main-circuit current detecting resistor 106 and the emitter terminal of the bipolar Darlington transistor 103 are connected.

A load current flowing an ignition coil 102 flows into the main-circuit-current detecting resistor 106 through the bipolar Darlington transistor 103. When a voltage drop in the main-circuit current resistor 106 generated by the current becomes about 0.6 V or more, the base-emitter voltage of the transistor 104 connected to the main-circuit current detecting resistor 106 also becomes about 0.6 V or more so that the transistor 104 operates to shunt a part of the base current of the bipolar Darlington transistor 104. As the base current of the bipolar Darlington transistor 103 decreases, the collector current which is a load current decreases. However, since the ignition coil 102 is a load having large inductance, the load current continues to flow, thereby enhancing the collector-emitter voltage of the bipolar Darlington transistor 103. As a result, the load current (i.e. collector current) becomes constant so that the voltage drop across the main-circuit current detecting resistor 106 is maintained constant (i.e. the operation of current limitation operates).

The resistor 111 and capacitor 112, which are not disclosed, serve to restrict the oscillation of current in the current limitation which is a known technique.

A driving circuit including resistors 107 and 108 and a transistor 105 is supplied with power from a battery 101, and when the transistor 105 is off, serves to cause the base current limited by the resistors 107 and 108 limited by the bipolar Darlington transistor 103 to flow into the bipolar Darlington transistor 103. But, the driving circuit should not be limited to the configuration of the driving circuit.

A Zener diode 110 is connected between the collector terminal and the base terminal of the bipolar Darlington transistor 103. The Zener diode 110 operates as follows. Because of the withstand voltage of the Zener diode 110 set at a lower voltage than that between the main terminals of the bipolar Darlington transistor 103, when the base current of the bipolar Darlington transistor 103 is removed so that it is turned off, an excess voltage applied from the ignition coil 102 passes a reverse current to the Zener diode 110. A part of the reverse current constitutes a base current of the bipolar Darlington transistor 103 so that the collector-emitter withstand voltage of the bipolar Darlington transistor 103 is substantially clamped by the Zener diode 110. This protects the bipolar Darlington transistor 103 from excess voltage. Then, almost all of the charges from the ignition coil is discharged as a collector current of the bipolar Darlington transistor 103. The zener diode 110 is illustrated in U.S. Pat. No. 4,030,469. An example of the method of fabricating the Zener diode 110 for the MOS gate structure transistor is disclosed in U.S. Pat. No. 5,115,369.

A configuration in which a capacitor is used in place of the Zener diode 110 is disclosed in Japanese Utility Model Examined publication No. Sho 55-48132, and used for protecting the transistor connected in series with the ignition coil.

FIG. 2 shows waveforms of a collector-emitter voltage and a corrector current before and after the current limitation operation by the bipolar Darlington transistor 103 in FIG. 6. As seen from the waveform shown in FIG. 2, at the position of the left side for paper, the collector-emitter voltage abruptly drops from 16 V to about 1 V. This timing is coincident with that when a base current not shown is supplied to the bipolar Darlington transistor 103. Thereafter, the collector current changes at the rate defined by a power supply voltage and the inductance of the ignition coil (the changing rate dic/dt per unit time=power supply voltage/inductance of ignition coil), but is subjected to the current limitation operation for limiting the collector current to a fixed value in the manner described in the prior art. The collector voltage while the collector current is limited is the result of subtraction of the voltage drop across the resistor element (mainly, resistance of the ignition coil) of the main circuit from the power supply voltage.

The explanation hitherto made applies to the case where the bipolar transistor is used as an element for controlling the ignition coil. In this case, where the transistor 105 and the resistor 108 in the driving circuit 109 of FIG. 6 are removed to realize the above function within a wide temperature range by using a 5 V series logic element, the large capacity 5 V series logic element having a current conducting capability of 20–50 mA is required although it depends on the current amplification factor of the bipolar Darlington transistor.

In order to miniaturize the entire ignition system, the driving current by the above 5 V series logic element is desired to be decreased by one order of magnitude. This can be easily accomplished by adopting a voltage-driving MOS gate structure transistor as an ignition coil current.

Where an existing MOS gate structure transistor (power MOSFET and IGBT) is applied to the circuit shown in FIG. 6, in the process in which the drain voltage abruptly increases at the time of initiation of current limitation as shown in FIG. 3, it becomes a value higher than the power supply voltage and also oscillates in an attenuation waveform. The optimization in the values of the resistor 111 and capacitor 112 and reduction of the rate (gain or amplification factor) of the output signal to the base signal of the transistor 104 in FIG. 6 is effective to suppress the current oscillation introduced when the collector current becomes constant, but is useless to prevent the above oscillation of the drain voltage.

FIG. 3 shows the waveforms of the voltage and current exhibiting the oscillation phenomenon. They are the waveforms of the drain voltage and drain current (ignition coil current) when the ignition coil current is controlled by the MOSFET with a withstand voltage of 250 V and driven by 5 V.

The oscillation of the drain voltage waveform as shown in FIG. 3 gives rise to the following problems.

(1) The voltage in proportion to the collector voltage oscillating toward the high voltage side of the ignition coil is induced so that sparking may occur in a sparking plug at an unexpected timing.

(2) Where a circuit for monitoring the drain voltage in order to monitor the operating status of the ignition system, the oscillation of the drain voltage immediately after the current limitation is started is harmful.

(3) The oscillation of the drain voltage waveform may lead to the oscillation during the entire period of the current limitation.

On the other hand, the reason why the bipolar Darlington transistor gives a very slight amount of the collector voltage oscillation immediately after start of the current limitation unlike the MOS gate structure transistor is attributable to that it has an entirely different output characteristic (which can be exhibited as a collector voltage in abscissa and a collector current in ordinate) from that of the MOS gate structure. FIG. 4 shows the output characteristic of the bipolar Darlington transistor actually used in a vehicle engine ignition circuit. The operating waveform when using this transistor is shown in FIG. 2. Further, FIG. 5 is an output characteristic chart of the MOS gate structure transistor (MOSFET in the present case) providing the waveform of FIG. 3. It is of course that IGBT provides the output characteristic similar to MOSFET. FIG. 4 is greatly different from FIG. 5 in the changing degree of the collector current for an increase in the collector voltage of 2 V or more. It can be seen from FIG. 4 that the bipolar Darlington transistor exhibits a greater change in the collector current.

The mechanism of less oscillation of the collector voltage in the bipolar Darlington transistor can be explained as follows. As described above in connection with the prior art, as the voltage across resistor 106 increases in proportion to an increase in the collector current (which is also an ignition coil current), a base current flows into the transistor 104 so that its collector-emitter path becomes conductive.

Then, in response to conduction of the transistor 104, a part of the current having been flowing as the base current to the Darlington transistor 103 through the resistors 108 and 107 is shunted as a collector current to the transistor 104. When the voltage across the resistor 106 is further increased, it operates to reduce the base current to the transistor 104 and to increase the base current to the transistor 103. Eventually, the voltage across the resistor 106 substantially depends on the base-emitter voltage characteristic of the transistor 104 so that the collector current of the transistor 103 is maintained constant. On the other hand, there is necessarily a time lag from when the base current starts to flow into the transistor 104 to when the collector current of the transistor 103 becomes constant. Thus, the base current to the transistor 103 gradually decreases from the value defined by the voltage of the battery 101 and resistors 108, 107 during the above time lag.

The mild increase in the collector voltage before the current limitation operation starts in the operation waveform in FIG. 2 should be attributable to the base current gradually reducing and the output characteristic of the bipolar Darlington transistor shown in FIG. 4. This mild increase in the collector voltage makes a change in the collector current immediately before the current limitation operation starts. The mild changes in the collector voltage and the collector current contribute to suppression of oscillation in the collector voltage.

Further, where there is a great change in the collector current at the collector voltage of about 2 V or more as shown in FIG. 4, even if the above time lag is zero so that the base current to the transistor 103 changes stepwise from the value defined by the voltage of the battery 101 and the resistors 108 and 107, the oscillation in the collector voltage immediately after the current limitation is anticipated to be very small for the following reason. The rise (oscillation) in the collector voltage immediately after the current limitation starts does not occur as long as the secular change in the ignition coil current does not shift from the increase to the decrease. Namely, when the secular change in the collector current shifts from the increase to the decrease and the collector voltage is going to rise at a certain base current, the collector current is relatively greatly increased in the transistor having an output as shown in FIG. 4. This increases the collector current which is decreasing. In other words, the transistor itself has a negative feedback function that the collector voltage increases for a decrease in the collector current. The negative feedback function makes difficult the shift of the ignition coil current from the increase to the decrease, thereby suppressing oscillation of the collector voltage.

On the other hand, as shown in FIG. 5, since a change in the collector current in the MOS gate transistor is very small at the collector voltage of about 2 V or higher, the increase in the collector current due to the increase in the collector voltage is very small. Therefore, the negative feedback function is very weak so that oscillation of the collector voltage is not suppressed.

SUMMARY OF THE INVENTION

The present invention has been made to solve the above program with the conventional devices, and therefore an object of the present invention is to provide a circuit device and a semiconductor device for igniting an internal combustion engine which can suppress oscillation in the collector voltage.

In order to attain the above object, according to a first aspect of the present invention, there is provided a circuit device for igniting an internal combustion engine, comprising: a battery serving as a power supply; an MOS gate structure transistor connected in series with a coil; a coil current detection unit and a circuit for reducing a gate voltage which serve to limit a coil current to a certain value continuously; and a circuit for applying a voltage due to a minute current flowing from a main terminal of the transistor into the gate terminal to a gate terminal when the voltage across the main terminal on the side of a higher voltage is higher than that at the gate terminal. The minute current may be 0.01 mA or 10 mA, preferably several mA.

According to a second aspect of the present invention, the circuit device further comprises a circuit is provided in which when the voltage at the main terminal is not higher than a value set within a range equal to or lower than a predetermined voltage and higher than the voltage at the gate terminal, a voltage due to a minute current flowing from the main terminal into a gate terminal is applied to the gate terminal in accordance with a certain value or a difference between the voltage at the main terminal and the voltage at the gate terminal, and when it is higher than said set voltage, an increase in the voltage due to said minute current is suppressed or the voltage is reduced or cut off. The predetermined voltage may be within a range from 20 V to 30 V, preferably 25 V.

According to a third aspect of the present invention, the circuit device further comprises a circuit for carrying out the operations of the circuits of the first or second aspect only while the voltage previously applied to the gate terminal is applied.

According to a fourth aspect of the present invention, the circuit device further comprises a detection circuit (monitor circuit) for detecting the voltage across a coil, a circuit provided between said detection circuit and a gate terminal for applying a voltage due to a minute current to a gate terminal when the voltage across the coil has a polarity opposite to a power supply voltage of a main circuit and is reduced by the degree not smaller than the voltage across the gate terminal, and a circuit for operating said voltage applying circuit only while the voltage previously applied to the gate terminal is applied.

According to a fifth aspect of the present invention, the circuit device further comprises a control device comprising: a battery serving as a power supply; an MOS gate structure transistor connected in series with a coil; a coil current detection unit and a circuit for reducing a gate voltage which serve to limit a coil current to a certain value continuously; wherein an operation point of said control device is set at a point with a small temperature change (determined by the control device) or its neighborhood.

According to a sixth aspect of the present invention, the circuit device is formed of a single chip or package of a part or all of circuits other than a battery and a coil.

Further, according to a seventh aspect of the present invention, a MOS gate structure transistor connected in series with a coil has an output characteristic that within a current range substantially equal to a coil current subjected to current limitation, in shift from an area (resistive area in a MOSFET, and a saturated area in IGBT) which is substantially equal to a coil current to be subjected to current limitation and in which a gate voltage is fixed to a constant voltage and the voltage at a main terminal of the transistor due to a main terminal current is not substantially changed, to another area with an abrupt increase (current limited) in the voltage, a change in a main terminal current for the voltage in the main terminal of 1 V is not smaller than a second predetermined value until the voltage across the main terminal reaches a first predetermined value. The first predetermined value is preferably 16 V, and second predetermined value is preferably 0.1 A.

The above and other objects and features of the present invention will be more apparent from the following description taken in conjunction with the accompanying drawings.

DETAILED DESCRIPTION OF THE PREFERRED EMBODIMENTS

Now, a description will be given in more detail of preferred embodiments of the present invention with reference to the accompanying drawings.

Figure 1:
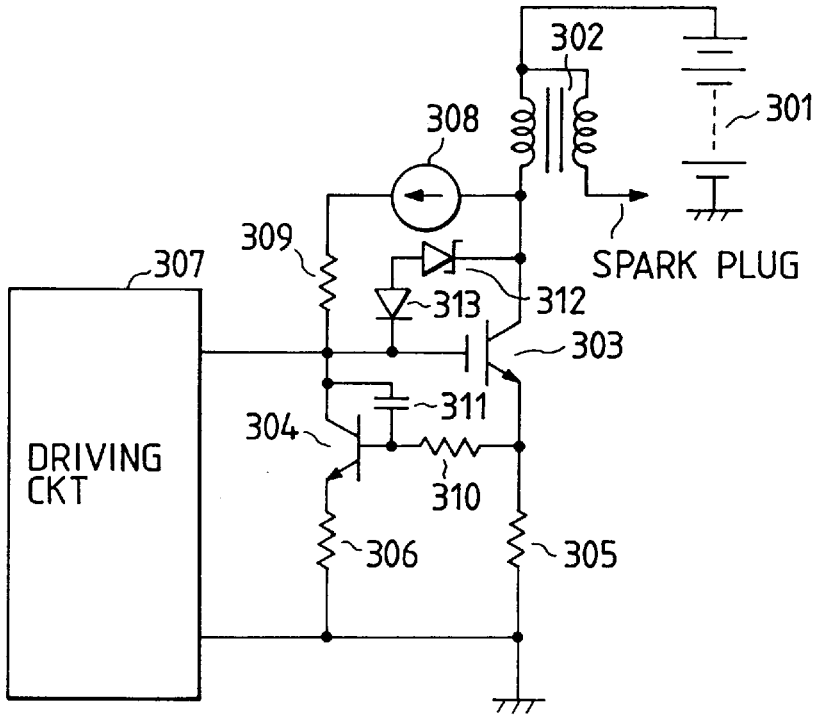
FIG. 1 is an ignition circuit according a first embodiment of the present invention using an IGBT.
Figure 2:
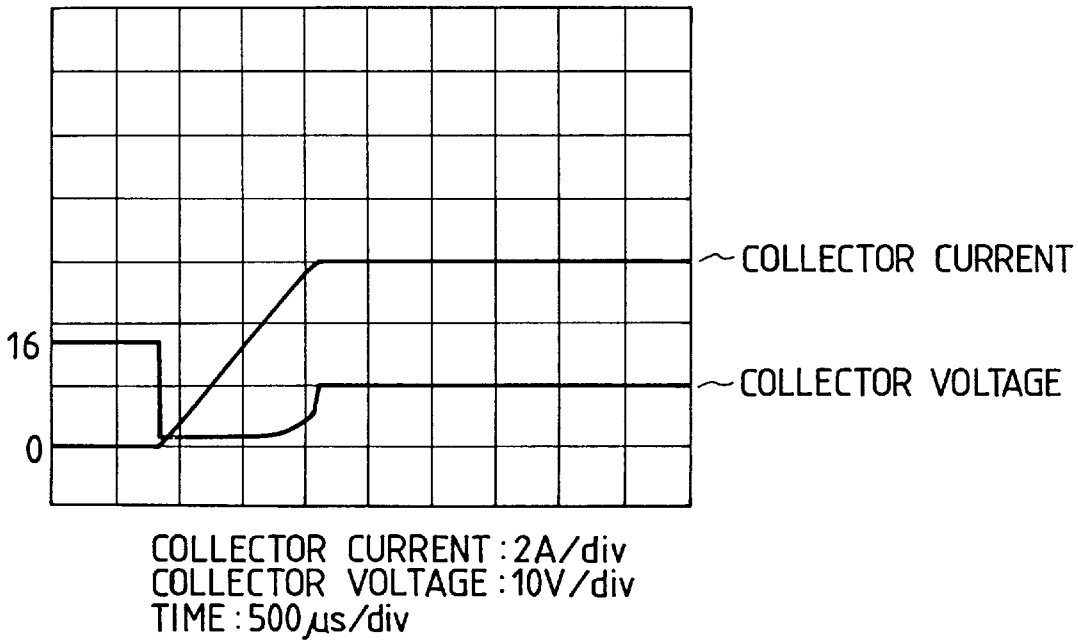
FIG. 2 is a collector voltage/current waveform chart when a current is limited using a bipolar Darlington transistor.

FIG. 1 is a diagram showing a circuit configuration according to a first embodiment of the present invention. In this embodiment, as a circuit for boosting the gate terminal voltage by the collector terminal voltage, a resistor 309 and a high withstand voltage constant current element 308 are connected in series between the collector and gate of an IGBT 303. The high withstand voltage constant current element 308 may be a deletion-structure MOSFET or IGBT, and may be formed into the IGBT 303 in FIG. 1. The high withstand voltage constant current element 308 with the withstand voltage set for a lower voltage than that of the IGBT 303 can be also served as a Zener diode 312. Otherwise, the high withstand voltage constant current element 308 may be a circuit such as a series power supply. In FIG. 1, reference numeral 301 denotes a battery; 302, an ignition coil; 304, a transistor; 305 and 306, resistors; 307, a driving circuit; 310, a resistor; 311, a capacitor; and 313, a diode.

Figure 4:
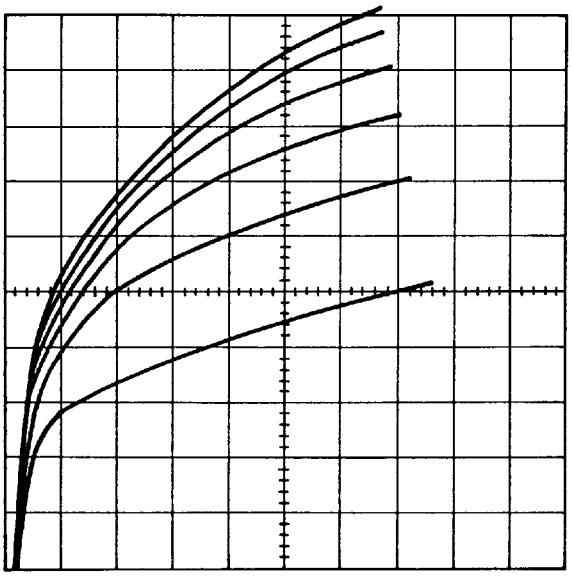
FIG. 4 is an output characteristic chart of a bipolar Darlington transistor.
Figure 12A:
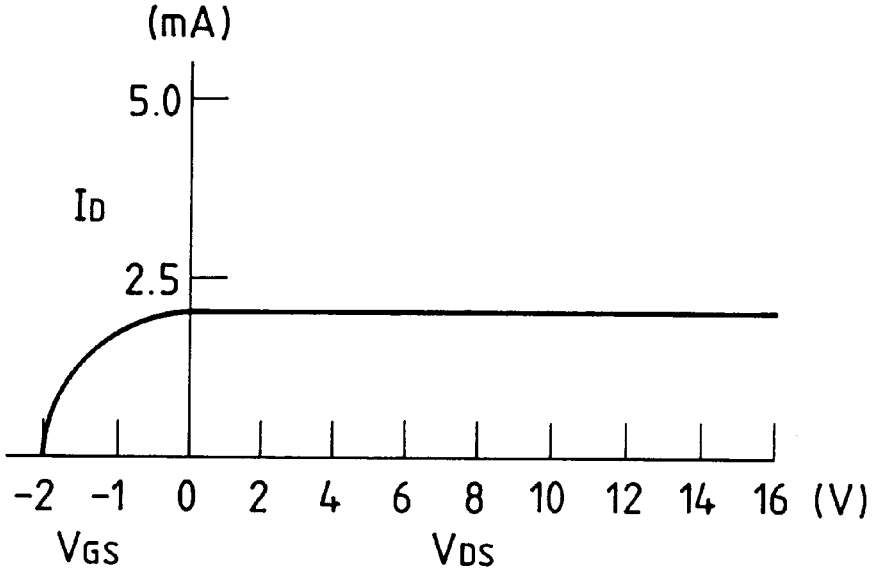
FIGS. 12A and 12B are graphs showing an example of setting a minute current applied from a collector terminal to a gate terminal or a collector voltage starting to suppress an increase in a voltage, respectively.
Figure 12B:
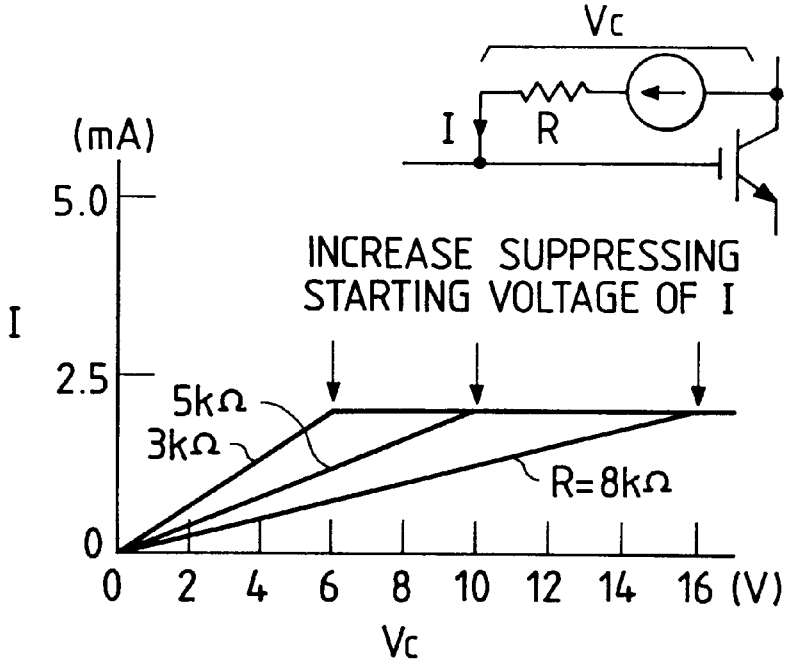

FIGS. 12A and 12B show an example in which the values of the constant current of the high withstand voltage constant current element 308 and the resistor 309 can define a collector voltage for suppressing an increase in the minute current flowing from a collector terminal to a gate terminal to establish a constant current. FIG. 12A shows a relationship between a drain current, and a gate-source voltage and a source-drain voltage in a depletion type MOSFET. As seen from the figure, when gate-source voltage is zero, the drain current is saturated at 2 mA and constant regardless of the source-drain voltage. Thus, the high withstand voltage constant current element serves as a constant current element. FIG. 12B shows a relationship between a collector voltage Vc of an IGBT and a minute current I flowing into the gate terminal thereof through the collector terminal to the resistor R when a resistor R (corresponding to a resistor 309) is set for 3 kΩ, 5 kΩ and 8 kΩ. The collector voltage Vc which provides a saturated current of 2 mA is 6 V for the resistance of 3 kΩ, 10 V for the resistance of 5 kΩ and 16 V for the resistance of 8 kΩ. Namely, the product of the resistor R and 2 mA is the collector voltage provided the saturated minute current I. When the minute current I is not saturated, it increases in proportion to the collector voltage Vc. The gate voltage, since the transistor 304 of FIG. 1 is "on", is defined by the voltage division ratio between the resistor 309 and the resistor 306 and increases with an increase in the collector voltage Vc and so the collector current also increases. Thus, the output characteristic of IGBT 303 is similar to that of the bipolar Darlington transistor of FIG. 4. As a result, oscillation of the collector voltage is suppressed to maintain the collector voltage constant. As understood from FIG. 12B, by setting the resistor R for a large value, the collector voltage Vc providing the saturated minute current I can be enhanced to suppress the oscillation in the collector voltage. The minute current I in practical use is within a range from 0.5 mA to 10 mA, and preferably 1 mA to 3 mA. When this minute current I increases, the amount of energy stored in the ignition coil consumed by the current is also increased, thus make it impossible to assure the spark voltage. In contrast, when it is too small, the output characteristic approaches from the bipolar Darlington transistor characteristic to the MOSFET characteristic, thus oscillating the collector voltage waveform. On the other hand, in order to turn off the IGBT 303 so that the ignition coil current is cut off to discharge the spark plug by the energy stored in the ignition coil, the voltage generated in the ignition coil must be maintained at several hundreds of V. For this purpose, the ignition coil must be as small as possible, and constant current flowing into the high withstand voltage constant current element must be as small as several mA. Namely, it is critical in this embodiment that in order to give the output characteristic of bipolar Darlington transistor to the IGBT 303, the resistor 309 is inserted between the gate and collector of the IGBT 303, and insure the spark voltage, the high withstand voltage constant current element 308 is connected in series with the resistor 309. Only one of the resistor 309 or the high withstand voltage constant current element 308 may be proposed.

Figure 7:
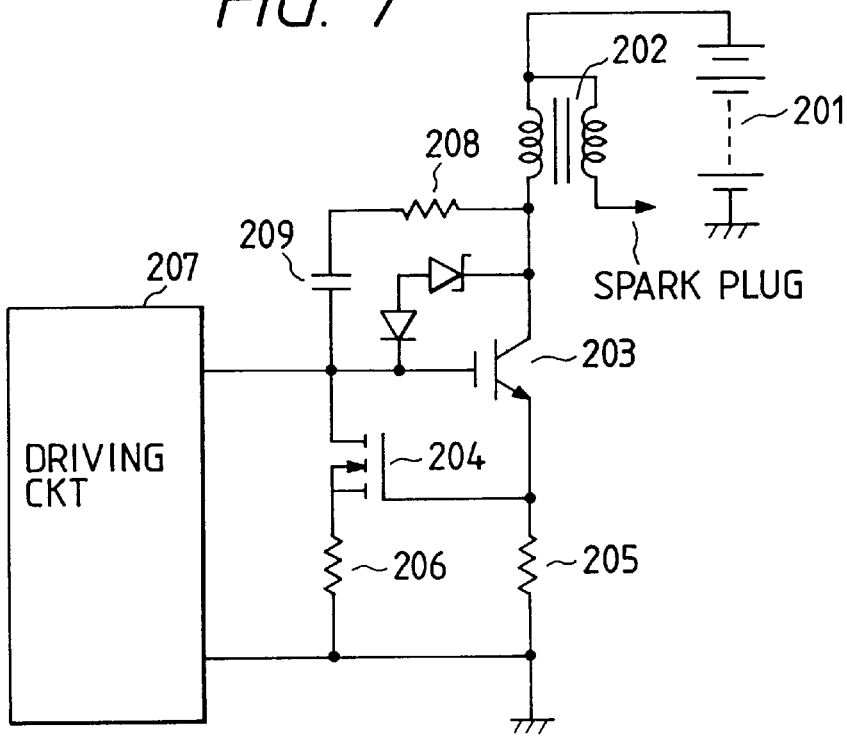
FIG. 7 is an ignition circuit diagram according to a second embodiment of the present invention using an IGBT.

FIG. 7 is a diagram showing a circuit configuration according to a second embodiment of the present invention in which a series circuit of a resistor 208 and a capacitor 209 is provided. The resistor 208 has the same operation as that of the resistor 309 in the first embodiment. Reference numeral 207 denotes a driving circuit. In operation, when the IGBT 203 turns off, the current from the ignition coil 202 decreases abruptly. In addition, the charges due to the minute current from the ignition coil 202 increases the voltage across the capacitor 209, thus assuring the spark voltage. The capacitor 209 performs the same operation as that of the high withstand voltage constant current element in the first embodiment. Only the capacitor 209 may be provided. In FIG. 7, reference numeral 201 denotes a battery, and 202 is an ignition coil.

A resistor 206 serves to reduce the changing degree of the drain voltage for the gate terminal of MOSFET 204 so that it further strengthens the effect of increasing the capacitor 208 and capacitor 209, thus suppressing the oscillation of the collector voltage. The series connection of the resistor 208 and the capacitor 209 in the second embodiment may be connected in series with the high withstand voltage constant current element 308 of FIG. 1.

In the first and second embodiments, the transistors 304 and 204 for reducing the gate voltage of IGBTs 303 and 304 may be circuit such as an operational amplifier as well as the transistor and MOSFET as a single element.

Figure 8:
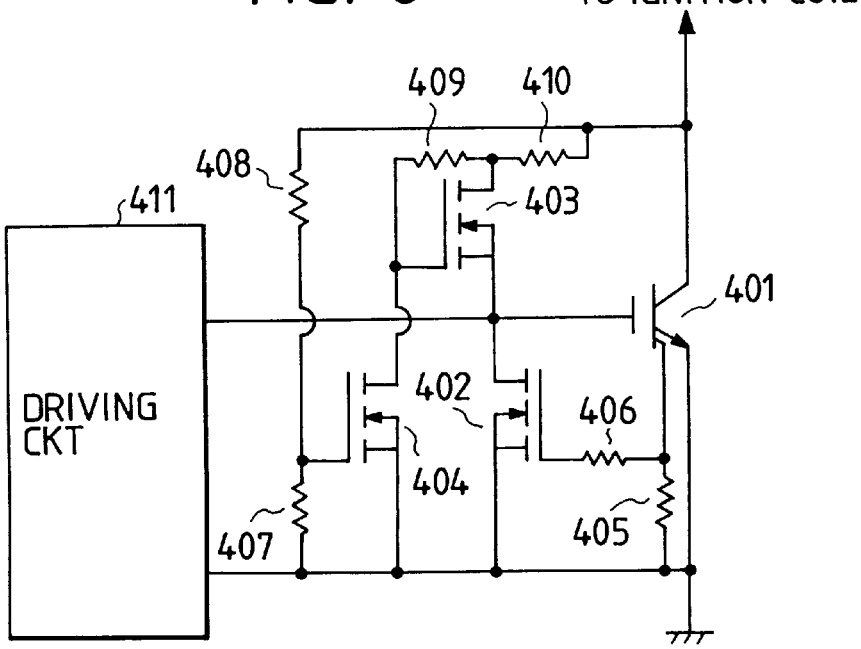
FIG. 8 is an ignition circuit diagram according to a third embodiment of the present invention.

FIG. 8 is a diagram showing a circuit configuration according to a third embodiment of the present invention. In this circuit configuration, a resistor 410 corresponds to a resistor 208 in the second embodiment. In operation, when an IGBT 401 turns off and the collector voltage becomes 25 V or more, the minute current through the resistor 410 is cut off by an MOSFET. A driving circuit 411 (having an attendant internal resistance) supplies a gate voltage to IGBT 401 so that it turns on. The IGBT 401 has a current detecting terminal, and generally referred to "current sense IGBT". The current detecting terminal is connected to a ground terminal through a resistor 405. The ignition coil serves as a collector current and flows through the IGBT. The increasing current is shunted to the current detecting terminal to boost the potential at the upper end of the resistor 405, thereby turning on the MOSFET 402. Then, since the collector-emitter voltage of IGBT 401 becomes very small, MOSFET 404 turns off. Thus, MOSFET 403 turns on. Since the resistor 410 is connected to the gate terminal of IGBT 401, the minute current flows through the resistor 410, MOSFET 403 and MOSFET 402 so that the voltage generated by the on-resistance of MOSFET 402 is applied to the gate of the IGBT 401. The collector current from the IGBT 401 eventually becomes constant by the action of the MOSFET 402. The resistor 410 is connected to the gate terminal of IGBT 402 so that the output characteristic of the IGBT 401 is converted into that of the bipolar Darlington transistor, thereby suppressing oscillation in the collector voltage. The MOSFET 403 is required to cut off the minute current from the ignition coil when the IGBT turns off, thus assuring the spark voltage. Further, although not shown, an additional resistor may be connected in parallel between the drain and source of the MOSFET 403 so that the minute current can be reduced at the collector voltage of 25 V or higher. In FIG. 8, reference numerals 406, 407, 408 and 409 denote resistors.

Figure 9:
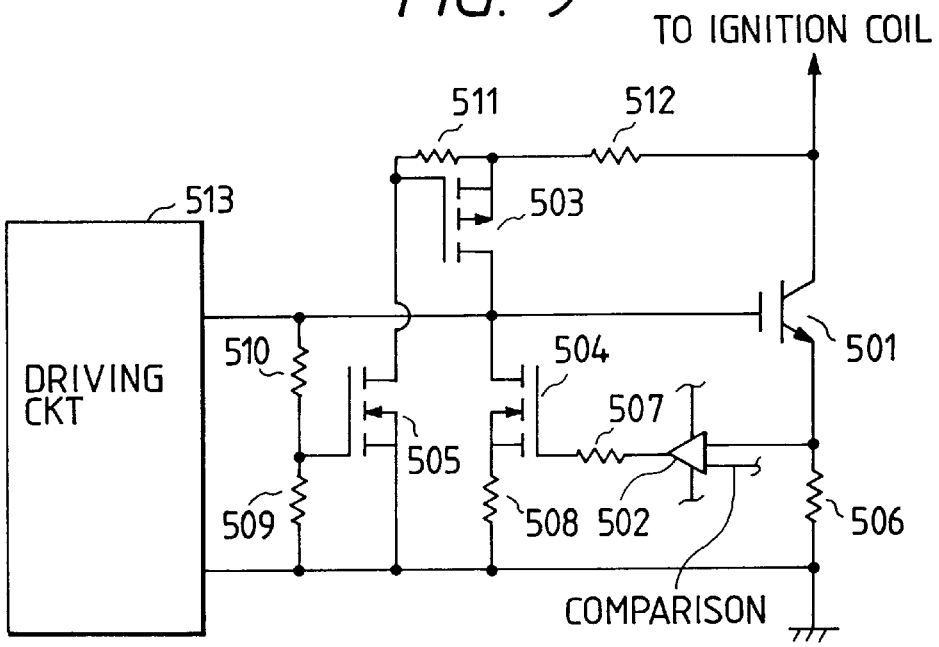
FIG. 9 is an ignition circuit diagram according to a fourth embodiment of the present invention.

FIG. 9 is a diagram showing a circuit configuration of a fourth embodiment of the present invention. By the action of a resistor 512 and MOSFET 503, the voltage due to a minute current is applied to the gate terminal of an IGBT 501 so that output characteristic of the IGBT 501 becomes close to that of a bipolar Darlington transistor. Namely, the resistor 512 and the MOSFET 503 correspond to the resistor 410 and MOSFET 403 in the third embodiment.

An operational amplifier 502 is connected between the emitter terminal of the IGBT 501 and the gate terminal of the MOSFET 504 through a resistor 507. The operational amplifier is designed to operate only while the voltage previously applied to the gate terminal of the IGBT 501 is applied by the driving circuit 501. Reference numeral 513 denotes a driving circuit; 506, 507, 508, 509 and 510, resistors, and 504, 505 are MOSFETs.

Figure 10:
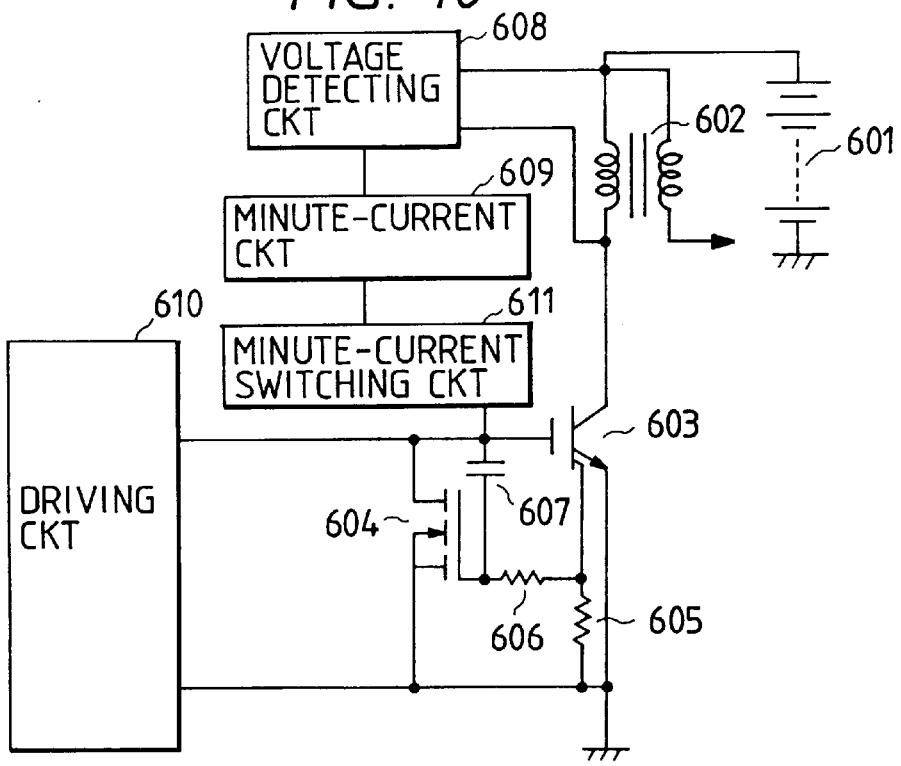
FIG. 10 is an ignition circuit diagram according to a fifth embodiment of the present invention.

FIG. 10 is a view showing a circuit configuration according to a fifth embodiment of the present invention. In this embodiment, a voltage detecting circuit (monitor circuit) 608 is provided to detect the voltage across the ignition coil 602 and monitor it. The voltage detecting circuit 608 is connected to a minute current circuit 609 which is in turn connected to the gate terminal of IGBT 603 through a minute current switching circuit 611. When the ignition coil voltage provides a drop higher than the gate voltage because of its polarity opposite to the power supply voltage for a main circuit or added to it, the gate voltage due to a minute current can be applied to the gate terminal, thus suppressing oscillation of the collector voltage. The IGBT 603 is provided with a current detection terminal. In the embodiment of FIG. 9, the minute current circuit 609 and the minute current switching circuit 611 perform the operations corresponding to those of the resistor 410 and the MOSFET 403, respectively. Reference numeral 610 denotes a driving circuit; 601, a battery; 602, an ignition coil; 605 and 606, resistors; and 604, MOSFET.

Figure 11:
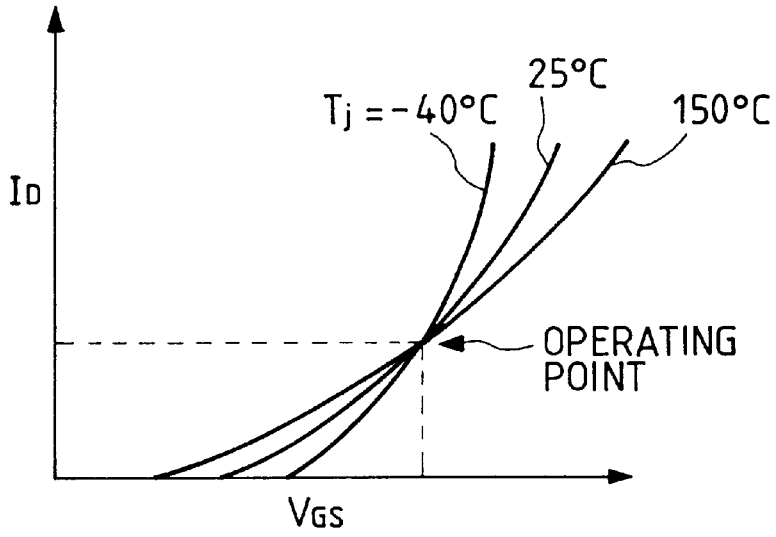
FIG. 11 is a graph showing an example of setting of an operating point with a small temperature change.

FIG. 11 is a view for setting operation points with a small change in the temperature of the transistor constituting a controller. Now, it is assumed that an MOSFET is used as a transistor. It is of course that FIG. 11 shows a typical example of reducing a temperature change of the operating point of a circuit component (transistor 304, 204 and circuit such as an operational amplifier) used in a control device. In FIG. 11, a temperature change of the current limitation value by setting the crossing point as an operating point.

Figure 5:
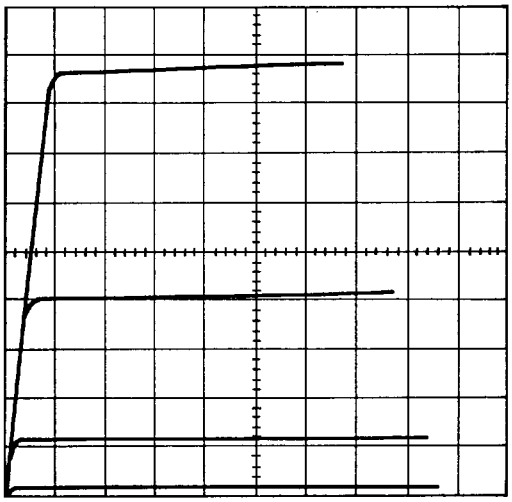
FIG. 5 is an output characteristic of a power MOSFET having a withstand voltage of 250 V and an on-resistance of 0.16 Ω.
Figure 6:
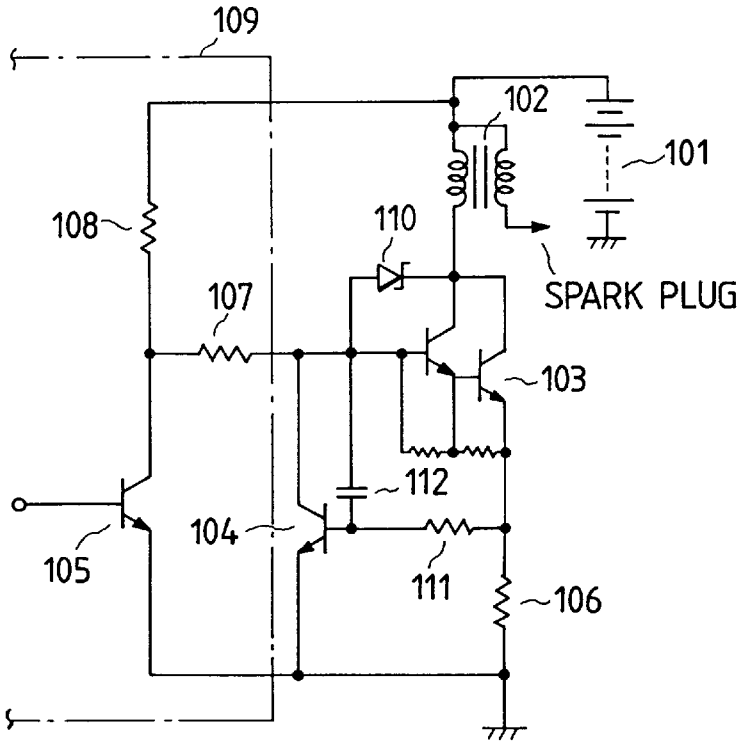
FIG. 6 is a circuit diagram of a conventional bipolar Darlington transistor.
Figure 13:
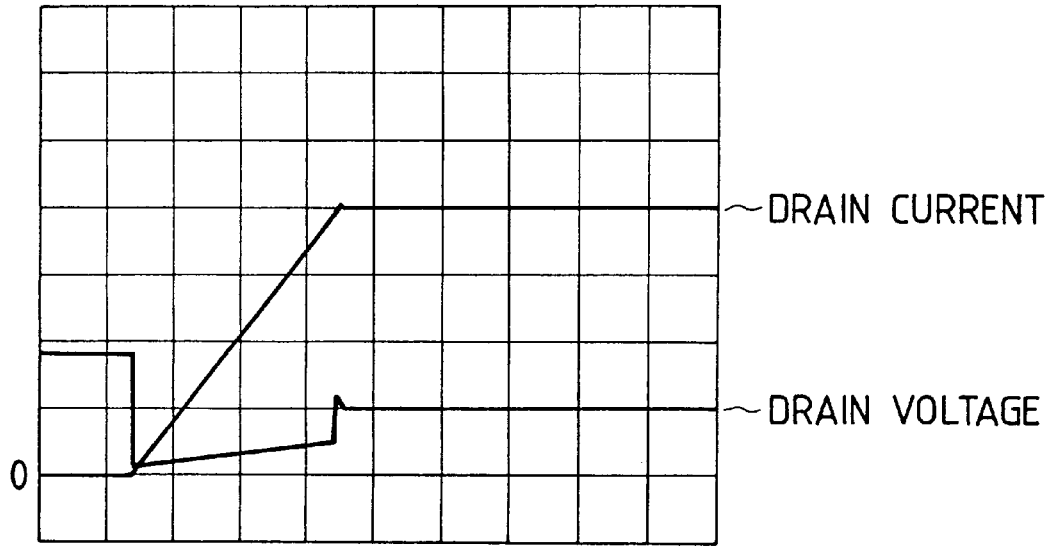
FIG. 13 is an operation waveform when the power MOSFET having an output characteristic of FIG. 5 is applied to the circuit of FIG. 6.

FIG. 13 is an operation waveform chart when the power MOSFET having an output characteristic of FIG. 5 is applied to the circuit of FIG. 6. It can be seen from FIG. 3 that provision of the circuit according to the present invention makes the output characteristic of MOSFET similar to that of the bipolar Darlington transistor so that oscillation of the drain voltage disappears.

The description hitherto was given of an application of the MOS gate structure transistor according to the present invention to an internal combustion engine ignition circuit device. But the present invention can provide a remarkable effect in its application to a circuit including an inductance of a wiring system.

For example, the circuit device according to the present invention can be applied to a switching element used in each of arms of a bridge circuit in an inverter for driving a motor. The present invention, when used to other inductive load than the ignition circuit, can the surge voltage when the MOS gate structure transistor.

Figure 3:
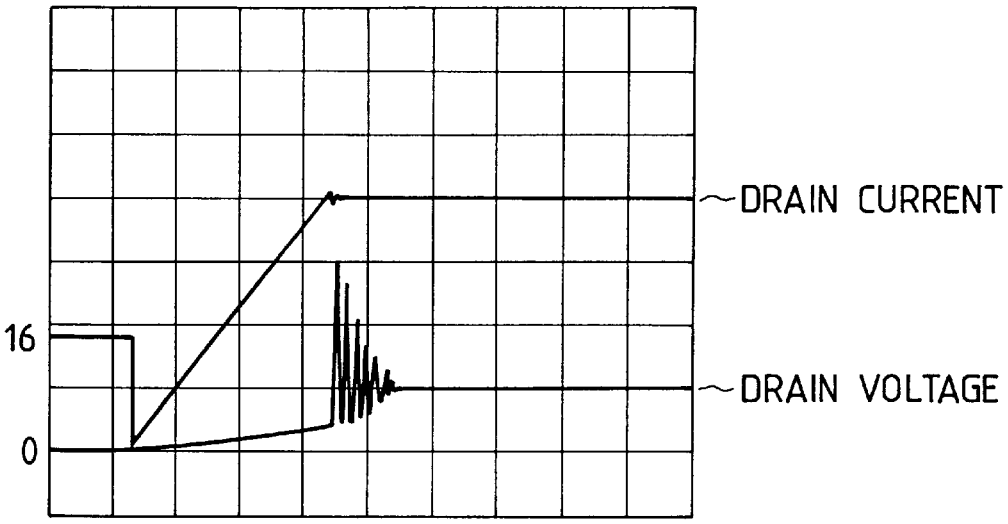
FIG. 3 is a collector voltage/current waveform chart when the current is limited using a power MOSFET.

As was described above, according to the first aspect of the invention, in a MOSFET gate structure transistor with a small change in the collector current at a collector voltage of about 2 V or more as shown in FIG. 1, an oscillation phenomenon occurs when the collector current is shifted from a saturated area to a current limited area. FIG. 3 shows the case where a MOSFET is used as a MOS gate structure transistor in which the oscillation phenomenon of the drain voltage corresponding to a collector voltage of IGBT is observed. In order to obviate such a defect, a circuit is provided in which when the collector voltage is higher than the gate voltage, the voltage due to the minute current flowing from the collector terminal to the gate terminal in a current limiting area is applied to the gate terminal. An increase in the collector voltage immediately after the current limitation operation starts, acts to boost the gate terminal voltage. The boosted gate terminal voltage promotes to increase the collector current so that the output characteristic of the MOS gate transistor becomes as if it is that of a bipolar Darlington transistor, thereby suppressing an abrupt increase in the collector voltage. When the collector voltage varies to decrease because of the oscillation, the action of boosting the gate voltage from the collector terminal is lowered so that the gate voltage becomes as if it is confined to suppress a drop in the collector voltage.

Since the transistor 304 shown in FIG. 1 operates to fix the collector current of IGBT 303, the gate voltage of the MOS gate structure transistor is instantaneously boosted to follow an increase in the collector. Where the collector voltage is higher than the gate voltage, an application of the voltage due to a minute current from the collector terminal to the gate terminal implies conversion of the output characteristic of the MOS gate transistor as shown in FIG. 5 into that of a bipolar Darlington transistor.

According to the second aspect of the invention, although the battery voltage adopted prevalently in a vehicle is 12 V, engine start using two batteries connected in series is also assumed. Thus, the power supply voltage when the ignition current is limited is 24 V (which is used only at the time of starting the engine, and even if voltage oscillation is taken in consideration, 20 V–30 V is used. This voltage may be changed in the future). The collector voltage of the MOS gate transistor when the current is limited has the contents described above so that the value of a power supply voltage must be taken into consideration. When this power supply voltage is taken in consideration, the operation according to the first aspect of the invention is sufficiently effective at the collector voltage of 25 V whereas the action of enhancing the gate voltage by the collector voltage is limited at the collector voltage exceeding 25 V. The first reason why the above action is limited at the collector voltage exceeding 25 V is as follows. Where an electrode of the battery is disconnected from a connection portion of a wiring terminal because of a surge of the power supply of the vehicle, the transistor 304 of FIG. 1 is required to pass a sufficient current. But, the surge voltage occurs rarely owing to the disconnection of the battery electrode. Therefore, it is not economic to enhance the current passing capability of the transistor 304 in FIG. 4 previously. Where the collector voltage exceeds 25 V in the current limiting operation, the increase of the minute current flowing from the collector terminal into the gate terminal is suppressed, or the minute current is reduced or cut off, thereby preventing the transistor 304 of FIG. 1 from being large-scaled. It is of course that the increase in the voltage generated by the minute current is suppressed, or this voltage is reduced or cut off.

According to the third aspect of the invention, the second reason why the above operation is suppressed under the collector voltage exceeding 25 V is as follows. This applies to the case where the gate voltage from the driving circuit 307 of FIG. 1 disappears and the MOS gate structure (IGBT 303) turns off. When the IGBT 303 turns off, the collector voltage reaches about 400 V. Then, if the action of boosting the gate terminal voltage by the collector terminal voltage is continued, a relatively large current flows into the driving circuit 307 of FIG. 1.

The collector voltage of IGBT is substantially clamped by the voltage of the Zener diode 312 of FIG. 1. In this clamping action, the current having flowed into the Zener diode flows into the driving circuit 307 to generate a voltage drop. When the generated voltage is boosted to a gate voltage permitting the IGBT 303 to operate, the IGBT 303 is made conductive thereby to process most of the energy discharged from an ignition coil.

However, if the action of boosting the gate terminal voltage by the collector terminal voltage where the collector voltage is higher than the gate voltage, which is a means of the present invention, is continued, a current higher than the zener diode current may flow. This current increases the voltage drop in the driving circuit of FIG. 1, thus hindering the energy discharged from the ignition coil at the collector voltage of the IGBT 303 which is substantially equal to the Zener diode voltage. Thus, it is probable that the collector voltage of the IGBT 303 cannot reach the Zener diode voltage. In order to overcome such an inconvenience, in accordance with the presence or absence of the gate voltage from the driving circuit of FIG. 1, with the gate voltage applied, if the gate terminal voltage is higher than the collector terminal voltage in the operation of current limitation, the operation of boosting the gate terminal voltage is carried out. On the other hand, if the gate voltage is not applied from the driving circuit of FIG. 1, the action of boosting the gate terminal voltage is released. Thus, the gate voltage of the IGBT 303 is boosted by the current 312 of FIG. 1 so that the energy stored in the ignition coil can be surely discharged by conduction of the IGBT 303.

According to the fourth aspect of the invention, when the bipolar Darlington transistor is served as the MOS gate structure transistor in a circuit as shown in FIG. 6, the same operation (or effect) as in the above the construction according the first aspect of the invention can be obtained. The construction according to the first aspect of the invention is characterized in that when the collector voltage of the transistor is higher than the gate terminal voltage, the voltage generated by the minute current flowing from the collector terminal into the gate terminal is applied to the gate terminal. On the other hand, the construction according to the fourth aspect of the invention is characterized in that the voltage across the coil is detected (monitored) to monitor the collector voltage indirectly, and when the collector voltage is higher than the gate terminal voltage, the voltage generated by the minute current is applied to the gate terminal.

In accordance with the construction of the fifth aspect of the invention, the operating point of the transistor 304 of FIG. 1 is set for the point with a small change of temperature. Thus, even when the environmental temperature is changed, a change in the limited current is made small.

In accordance with the construction of the sixth aspect of the invention, since a circuit is provided in which the output characteristic of the MOS gate structure transistor is made similar to that of the existing bipolar Darlington transistor, oscillation of the collector voltage immediately after the current limitation starts can be suppressed. Such a circuit is integrated to form a semiconductor device.

The construction according to the seventh aspect of the invention provides a semiconductor device in which in the output characteristic of the MOS gate structure transistor having a construction of the sixth aspect of the invention, in a current limited area within the collector voltage up to 16 V, the changing degree of the collector current for the collector voltage of 1 V is set for 0.1 A, thus suppressing oscillation of the collector voltage. Incidentally, with the current of 0.1 mA, it is actually difficult to suppress the oscillation As described above, first, in accordance with the present invention, the MOS gate structure transistor permitting a lower driving current than that of the conventional bipolar Darlington transistor can be applied to a vehicle ignition circuit.

Secondly, a spark in a spark plug can be prevented from occurring at an expected timing during a constant current operation of the ignition coil current providing the first effect.

Thirdly, oscillation of the drain voltage immediately after the current limitation is started can be prevented (such an oscillation gives an injurious effect on provision of a circuit for monitoring the drain voltage in order to monitor the operation circumstance of an ignition system).

Fourthly, the waveform oscillation over the entire period of the current limitation operation can be prevented. The present invention can provide the above effects.

The foregoing description of a preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A circuit device for igniting an internal combustion engine, comprising:

a battery serving as a power supply;

a coil;

an MOS gate structure transistor having a main terminal, a gate terminal, and an output terminal, connected in series with said coil;

a coil current detector for detecting a coil current flowing in said coil;

means for reducing a gate terminal voltage at said gate terminal of said MOS gate structure transistor to limit the coil current to a predetermined value; and means for applying a voltage from said main terminal of said MOS gate structure transistor to the gate terminal when the main terminal voltage is higher than the gate terminal voltage.

2. A circuit for igniting an internal combustion engine according to claim 1, wherein a current flowing from the main terminal to the gate terminal is 0.01 mA to 10 mA.

3. A circuit for igniting an internal combustion engine according to claim 1, further comprising a circuit in which, when the main terminal voltage is not higher than a value set within a range equal to or lower than a predetermined voltage and higher than the voltage at the gate terminal, a voltage from the main terminal into the gate terminal is applied to the gate terminal in accordance with a certain value or a difference between the main terminal voltage and the gate terminal voltage, and when the main terminal voltage is higher than said set value, an increase in the main terminal voltage is suppressed or the main terminal voltage is reduced or cut off.

4. A circuit for igniting an internal combustion engine according to claim 3, wherein said predetermined voltage is within a range from 20 V to 30 V.

5. A circuit for igniting an internal combustion engine according to claim 1, further comprising a circuit for operating the voltage applying circuit only while the voltage previously applied to the gate terminal is applied.

6. A circuit device for igniting an internal combustion engine comprising;

a battery serving as a power supply;

a coil;

an MOS gate structure transistor having a main terminal, a gate terminal and an output terminal, connected in series with said coil;

a coil current detection unit for detecting a coil current flowing in said coil;

means for reducing a gate terminal voltage to limit the coil current to a predetermined value continuously;

a detection circuit for detecting a voltage across the coil; and means for applying a voltage from said main terminal to said gate terminal and means for operating the applying means in response to a voltage applied to the gate terminal.

7. A semiconductor device for igniting an internal combustion engine which is a single chip or package of a part or all of circuits other than the battery and coil of the circuit device for igniting an internal combustion engine according to one of claims 1 to 6.

8. A circuit device for igniting an internal combustion engine which is a control device comprising:

a battery serving as a power supply;

a coil;

an MOS gate structure transistor connected in series with said coil;

a coil current detection unit for detecting a coil current flowing in said coil; and means for reducing a gate voltage to limit the coil current to a predetermined value continuously;

wherein an operation point of said control device is set at a point with a small temperature change.

9. A semiconductor device for igniting an internal combustion engine which is a single chip or package of a part or all of circuits other than the battery and coil of the circuit device for igniting an internal combustion engine according to claim 8.

* * * * *